US011300142B2

(12) United States Patent
Ling et al.

(10) Patent No.: US 11,300,142 B2
(45) Date of Patent: Apr. 12, 2022

(54) FAN AND MOTOR THEREOF

(71) Applicant: Delta Electronics, Inc., Taoyuan (TW)

(72) Inventors: Wei-I Ling, Taoyuan (TW); Chih-Chung Chen, Taoyuan (TW); Meng-Yu Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 135 days.

(21) Appl. No.: 16/682,241

(22) Filed: Nov. 13, 2019

(65) Prior Publication Data

US 2020/0224678 A1 Jul. 16, 2020

(30) Foreign Application Priority Data

Jan. 11, 2019 (CN) ..... 201910026565.X

(51) Int. Cl.
*F04D 29/66* (2006.01)
*F04D 29/043* (2006.01)

(52) U.S. Cl.
CPC ..... *F04D 29/668* (2013.01); *F04D 29/043* (2013.01)

(58) Field of Classification Search
CPC ..... F04D 29/668; F04D 29/043
See application file for complete search history.

(56) References Cited

U.S. PATENT DOCUMENTS 3,786,290 A * 1/1974 Papst ..... F04D 29/056 310/90
4,452,541 A * 6/1984 Carpenter ..... F16C 17/08 384/223
5,982,064 A 11/1999 Umeda et al.
6,024,496 A * 2/2000 Shy ..... F04D 29/063 384/279

(Continued)

FOREIGN PATENT DOCUMENTS

CN 2492694 Y 5/2002
CN 1896547 A 1/2007

(Continued)

OTHER PUBLICATIONS

NPL Chiyne—Cyrbr, "Rubber Spring", copyright 2018. (Year: 2018).*

(Continued)

*Primary Examiner* — Woody A Lee, Jr.
*Assistant Examiner* — Wesley Le Fisher
(74) *Attorney, Agent, or Firm* — Kirton McConkie; Evan R. Witt

(57) ABSTRACT

A fan includes a base, a motor and an impeller, and the motor includes a sleeve, a rotor, a position limiting element and a composite elastic element. The sleeve is disposed on the base, and the sleeve has a bottom portion and a side wall, which constitute an accommodation space. The rotor has a rotating shaft disposed within the accommodation space, and the rotating shaft has an outer wall. An annular groove is formed on the outer wall and has a surface. The position (Continued)

limiting element is disposed on the sleeve and extended from the side wall toward the rotating shaft, and the position limiting element has a bottom surface. The bottom surface faces toward the bottom portion, and the bottom surface is interfered with the surface, thereby eliminating the gap between the bottom surface and the surface. Therefore, noise of the up and down vibration is avoided from generating.

7 Claims, 4 Drawing Sheets

(56) References Cited

U.S. PATENT DOCUMENTS 6,897,586 B2 * 5/2005 Horng ..... H02K 5/15 310/67 R
7,182,517 B2 * 2/2007 Liu ..... F16C 17/08 384/125
7,291,952 B2 * 11/2007 Chen ..... H02K 5/1675 310/90
7,521,830 B2 * 4/2009 Chen ..... F16C 33/103 310/90
7,567,003 B2 7/2009 Hong et al.
8,134,263 B2 * 3/2012 Yazawa ..... F04D 25/0626 310/90
2007/0013247 A1 * 1/2007 Tung ..... F04D 29/668 310/90
2007/0152525 A1 * 7/2007 Horng ..... F16C 17/10 310/90
2008/0063527 A1 * 3/2008 Yeh ..... F04D 25/062 416/174
2009/0261692 A1 * 10/2009 Horng ..... F16C 17/08 310/425
2014/0178184 A1 * 6/2014 Chou ..... H02K 5/1677 415/177

FOREIGN PATENT DOCUMENTS

CN 201236834 Y 5/2009
CN 101520051 A 9/2009
CN 201368044 Y 12/2009
CN 204061239 U 12/2014
TW 200702565 A 1/2007
TW I599726 B 9/2017

OTHER PUBLICATIONS

NPL Durometer; "Durometer Shore Hardness Scale", Jul. 4, 2018; (Year: 2018).*
CNIPA first office action of instant foreign filing—original (Year: 2021).*
CNIPA first office action of instant foreign filing—official English translation (Year: 2021).*
CNIPA first search report of instant foreign filing (Year: 2021).*
NPL Silicone Rubber, "Silicone Rubber", Dec. 13, 2018 (Year: 2018).*

* cited by examiner

FAN AND MOTOR THEREOF

FIELD OF THE INVENTION

The present disclosure relates to a fan and a motor thereof, and more particularly to a fan and a motor thereof that can avoid the noise of the vibration from generating.

BACKGROUND OF THE INVENTION

In current industry, fans are widely used in kinds of products, such as in vehicles or electronic devices, for heat dissipation. Generally, in the fan, the impeller and the motor are assembled, and the impeller is driven by the rotation of the motor, so that heat dissipation is achieved.

Conventionally, the shaft of the motor is matched with the retaining ring to limit the axial displacement of the shaft and prevent the shaft from being disengaged due to the flipping. Meanwhile, the shaft can be limited to the center position by the retaining ring, so as to avoid the radial offset of the shaft.

However, in conventional motor, while the shaft and the retaining ring are assembled, a gap is generated between the shaft and the retaining ring. Therefore, when the motor is operated, or when the motor is shaken by an external force, the friction between the components is caused due to the gap, and the noise of the up and down vibration is generated. In addition, the abrasion of the components is increased because of the friction, such that the life span of the motor is shortened.

For overcoming the drawbacks of the conventional technologies, there is a need of providing an improved fan and a motor thereof, so that the gap between the components is eliminated, and the friction and the noise of the up and down vibration can be decreased.

SUMMARY OF THE INVENTION

An object of the present disclosure provides a fan and a motor thereof to address the issues encountered by the prior arts.

In accordance with an aspect of the present disclosure, there is provided a fan and a motor thereof. Through interfering the bottom surface of the position limiting element with the annular groove of the outer wall of the rotating shaft, the gap therebetween is eliminated, so as to avoid the generation of the noise of the up and down vibration and achieve the effect of reducing noise.

In accordance with another aspect of the present disclosure, there is provided a fan and a motor thereof. By disposing the composite elastic element, which is compressible and is able to rebound, and interfering the position limiting element with the annular groove of the rotating shaft, there is no gap between the bottom surface of the position limiting element and the rotating shaft, such that the generation of vibration noise is prevented, and the abrasion of components is avoided.

In accordance with another aspect of the present disclosure, there is provided a fan and a motor thereof. Through disposing the composite elastic element, which is integrally formed and has the certain hardness, and assembling and matching the position limiting element disposed on the sleeve with the rotating shaft, the noise is avoided from generating, and the assembly of the motor is facilitated.

In an embodiment, the fan includes a base, a motor and an impeller. The motor includes a sleeve, a rotor, a position limiting element and a composite elastic element. The sleeve is disposed on the base, and the sleeve has a bottom portion and a side wall. The bottom portion and the side wall constitute an accommodation space. The rotor has a rotating shaft, and the rotating shaft is disposed within the accommodation space and has an outer wall. An annular groove is formed on the outer wall, and the annular groove has a surface. The position limiting element is disposed on the sleeve and extended from the side wall toward the rotating shaft. The position limiting element has a bottom surface, the bottom surface faces toward the bottom portion, and the bottom surface is interfaced with the surface. The composite elastic element is disposed on the bottom portion and abutted against a first end of the rotating shaft. The impeller is connected with a second end of the rotating shaft, and the first end and the second end are located at different ends of the rotating shaft.

In an embodiment, the motor includes a sleeve, a rotor and a position limiting element. The sleeve has a bottom portion and a side wall, and the bottom portion and the side wall constitute an accommodation space. The rotor has a rotating shaft, and the rotating shaft is disposed within the accommodation space and has an outer wall. An annular groove is formed on the outer wall, and the annular groove has a surface. The position limiting element is disposed on the sleeve and extended from the side wall toward the rotating shaft. The position limiting element has a bottom surface, the bottom surface faces toward the bottom portion, and the bottom surface is interfaced with the surface.

In an embodiment, the motor includes a sleeve, a rotor, a composite elastic element and a position limiting element. The sleeve has a bottom portion and a side wall, and the bottom portion and the side wall constitute an accommodation space. The rotor has a rotating shaft, the rotating shaft is disposed within the accommodation space and has an outer wall, and an annular groove is formed on the outer wall. The composite elastic element is disposed on the bottom portion and abutted against a first end of the rotating shaft. The position limiting element is disposed on the sleeve and extended from the side wall toward the rotating shaft until in the annular groove, and the rotating shaft is clamped by the position limiting element and the composite elastic element.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
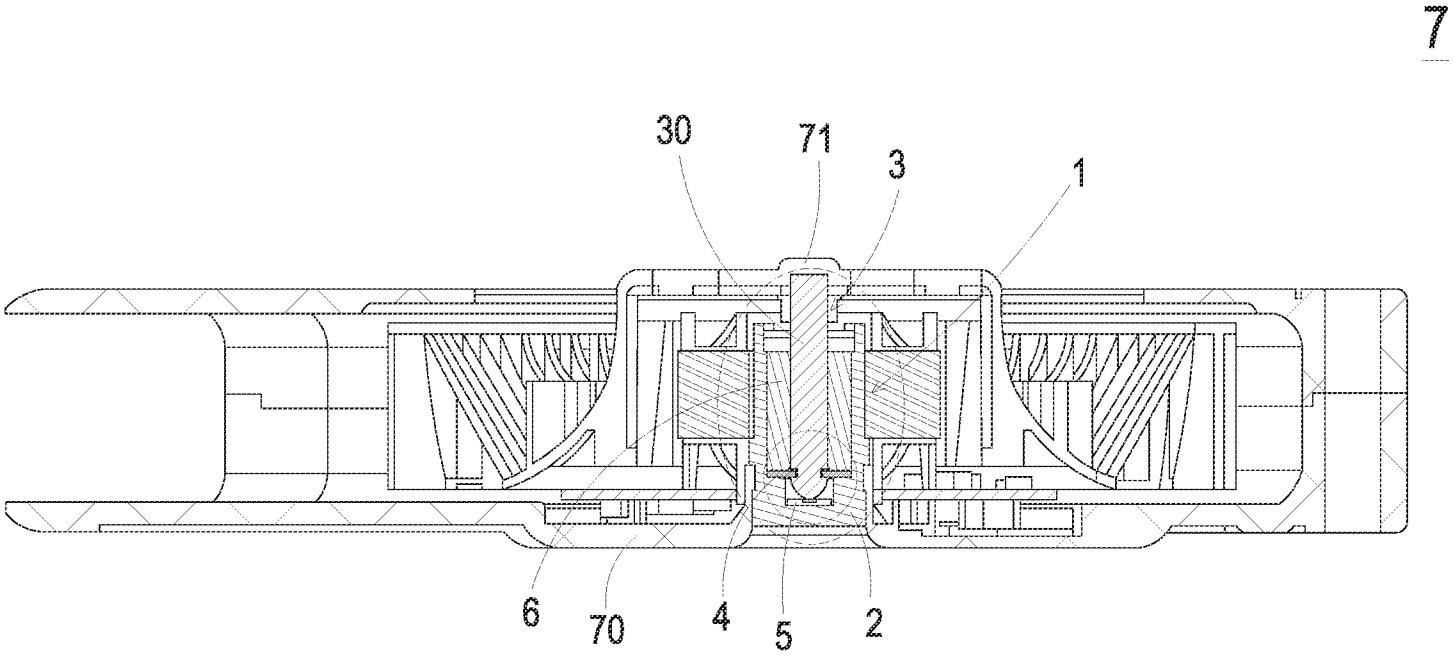
FIG. 1 schematically illustrates the cross-sectional structure of a fan and a motor thereof according to an embodiment of the present disclosure.
Figure 2:
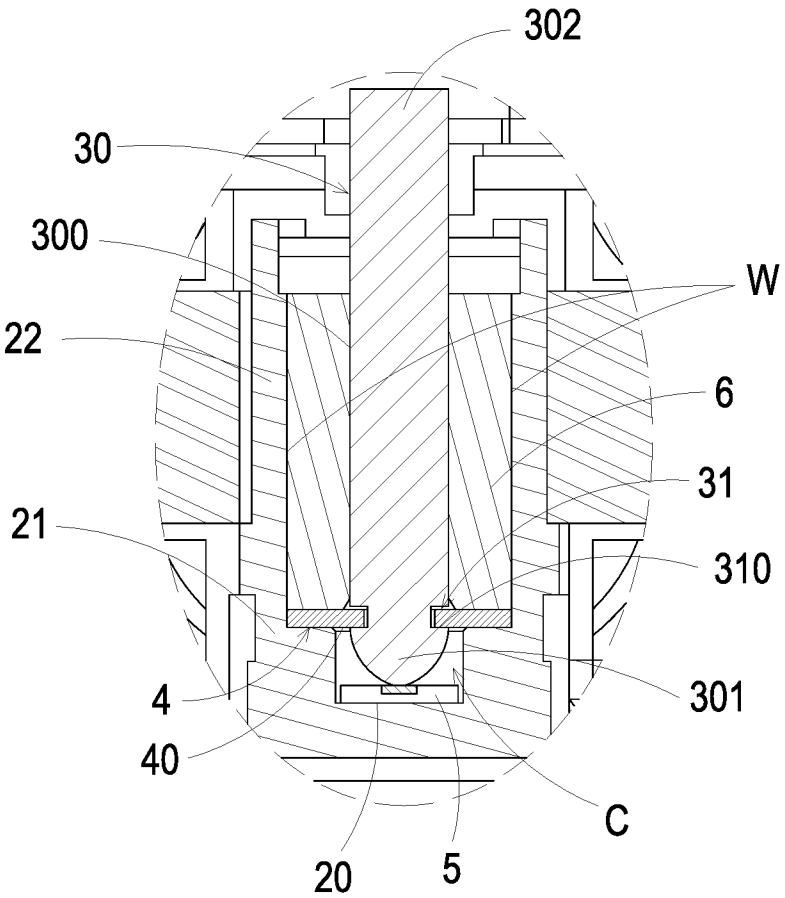
FIG. 2 schematically illustrates the detailed structure of the fan and the motor as shown in FIG. 1.
Figure 3:
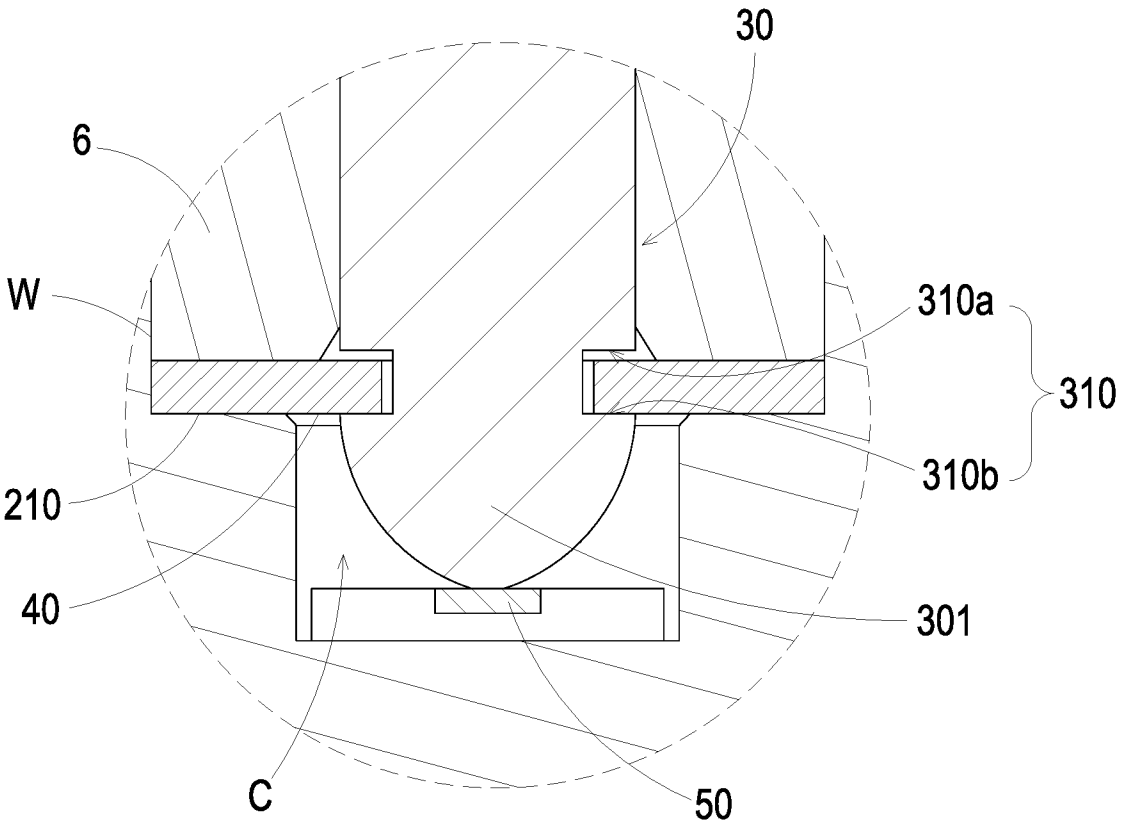
FIG. 3 schematically illustrates another detailed structure of the fan and the motor as shown in FIG. 1.

Please refer to FIG. 1, FIG. 2 and FIG. 3. FIG. 1 schematically illustrates the cross-sectional structure of a fan and a motor thereof according to an embodiment of the present disclosure. FIG. 2 schematically illustrates the detailed structure of the fan and the motor as shown in FIG. 1. FIG. 3 schematically illustrates another detailed structure of the fan and the motor as shown in FIG. 1. As shown in FIG. 1, FIG. 2 and FIG. 3, the motor 1 of the present disclosure includes a sleeve 2, a rotor 3 and a position limiting element 4. The sleeve 2 has a bottom portion 20 and a side wall W, and the bottom portion 20 and the side wall W constitute an accommodation space C. The rotor 3 has a rotating shaft 30, the rotating shaft 30 is disposed within the accommodation space C, and the rotating shaft 30 has an outer wall 300, which is opposite to the side wall W of the sleeve 2. An annular groove 31 is formed on the outer wall 300 of the rotating shaft 30, and the annular groove 31 has a surface 310.

The position limiting element 4 is disposed on the sleeve 2, and the position limiting element 4 is extended from the side wall W of the sleeve 2 toward the center of the rotating shaft 30. The position limiting element 4 includes for example but not limited to a retaining ring or a suction buckle, which is assembled and matched with the annular groove 31 of the rotating shaft 30, so as to perform the position limitation along the axial direction and the radial direction to the rotating shaft 30. The position limiting element 4 has a bottom surface 40, and the bottom surface 40 faces toward the bottom portion 20, that is, the orientation that the bottom surface 40 towards is opposite to the orientation that the bottom portion 20 towards. The bottom surface 40 of the position limiting element 4 is interfaced with the surface 310 of the annular groove 31. For example, part of the bottom surface 40 is contacted with or abutted against part of the surface 310, but not limited herein.

In some embodiments, the surface 310 of the annular groove 31 includes a first surface 310*a* and a second surface 310*b* opposite to the first surface 310*a*. The first surface 310*a* faces toward the bottom portion 20, and the second surface 310*b* faces toward the bottom surface 40 of the position limiting element 4, that is, the orientation that the first surface 310*a* towards is identical to the orientation that the bottom surface 40 towards, and the orientation that the second surface 210*b* towards is identical to the orientation that the bottom portion 20 towards. The bottom surface 40 of the position limiting element 4 is contacted with the second surface 310*b* of the annular groove 31, such that there is no gap between the bottom surface 40 and the second surface 310*b*. The bottom surface 40 is, for example, flatly attached on the second surface 310*b*, but not limited herein.

In other words, in the fan of the present disclosure, through interfering the bottom surface of the position limiting element with the annular groove of the outer wall of the rotating shaft, the gap between the bottom surface of the position limiting element and the surface of the annular groove is eliminated, so as to avoid the generation of the noise of the up and down vibration and achieve the effect of reducing noise.

In some embodiments, the motor 1 further includes a composite elastic element 5. The composite elastic element 5 is disposed on the bottom portion 20 and abutted against a first end 301 of the rotating shaft 30. That is to say, the first end 301 of the rotating shaft 30 is extended and disposed within the accommodation space C, and the first end 301 is abutted against the composite elastic element 5. In some embodiments, the position limiting element 4 is disposed on the sleeve 2, and the position limiting element 4 is extended from the side wall W of the sleeve 2 toward the rotating shaft 30 until in the annular groove 31, and preferably, the rotating shaft 30 is clamped by the position limiting element 4 and the composite elastic element 5.

The composite elastic element 5 can be, for example but not limited to, a composite rubber element, and a side surface of the composite rubber element is integrally formed with a wear-resistant structure 50. The wear-resistant structure 50 is contacted with the first end 301 of the rotating shaft 30, and the wear-resistant structure 50 is abutted against the first end 301 through the method with the smallest friction. For example, the composite elastic element 5 can be integrally formed by the coating injection molding method, and the material of the wear-resistant structure 50 can be the polyetheretherketone (i.e., PEEK), but nor limited herein. Therefore, the composite elastic element 5 can withstand the wear of the first end 301 of the rotating shaft 30, and provide the elastic force of the compression and rebound at the same time, which facilitates the interference between the bottom surface 40 of the position limiting element 4 and the surface 310 of the annular groove 31, and also benefits the assembly of the motor 1.

In some embodiments, a Shore A hardness of the composite elastic element 5 is 70 to 90 degrees. Preferably, the Shore A hardness of the composite elastic element 5 is 80 degrees. Consequently, the composite elastic element 5 has better performance in bearing abrasion and providing elasticity.

In some embodiments, the motor 1 further includes a bearing 6. The bearing 6 is accommodated in the sleeve 2, and the rotating shaft 30 is penetrated through the bearing 6. Furthermore, the first end 301 of the rotating shaft 30 is exposed outside the bearing 6, so that the annular groove 31 and the first end portion 301 are not covered by the bearing 6, and the first end 301 is disposed within the accommodation space C. The sleeve 2 includes a base portion 21 and an extending portion 22. The base portion 21 has a side edge 210 and the bottom portion 20, and the extending portion 22 has the side wall W, among which the extending portion 22 is connected with the base portion 21. The extending portion 22 of the sleeve 2 is contacted with the bearing 6, and the position limiting element 4 is clamped by the side edge 210 of the base portion 21 and the bearing 6, or the position limiting element 4 is clamped by the side edge 210 and the extending portion 22.

In some embodiments, as shown in FIG. 1 and FIG. 2, the base portion 21 and the extending portion 22 of the sleeve 2 are integrally formed, and the sleeve 2 and the bearing 6 are constructed as a closed bearing system. During the assembly process of the closed bearing system, for example, but not limited to, the composite elastic element 5 is disposed on the bottom portion 20, firstly. Next, the position limiting element 4 is disposed on the side edge 210 of the base portion 21 of the sleeve 2, and the bearing 6 is penetrated through the extending portion 22 of the sleeve 2, such that the position limiting element 4 is clamped by the sleeve 2 and the bearing 6. Then, the rotating shaft 30 of the rotor 3 is penetrating through the bearing 6, so that the composite elastic element 5 is abutted against the rotating shaft 30, and the bottom surface 40 of the position limiting element 4 is interfaced with the surface 310 of the annular groove 31.

Figure 4:
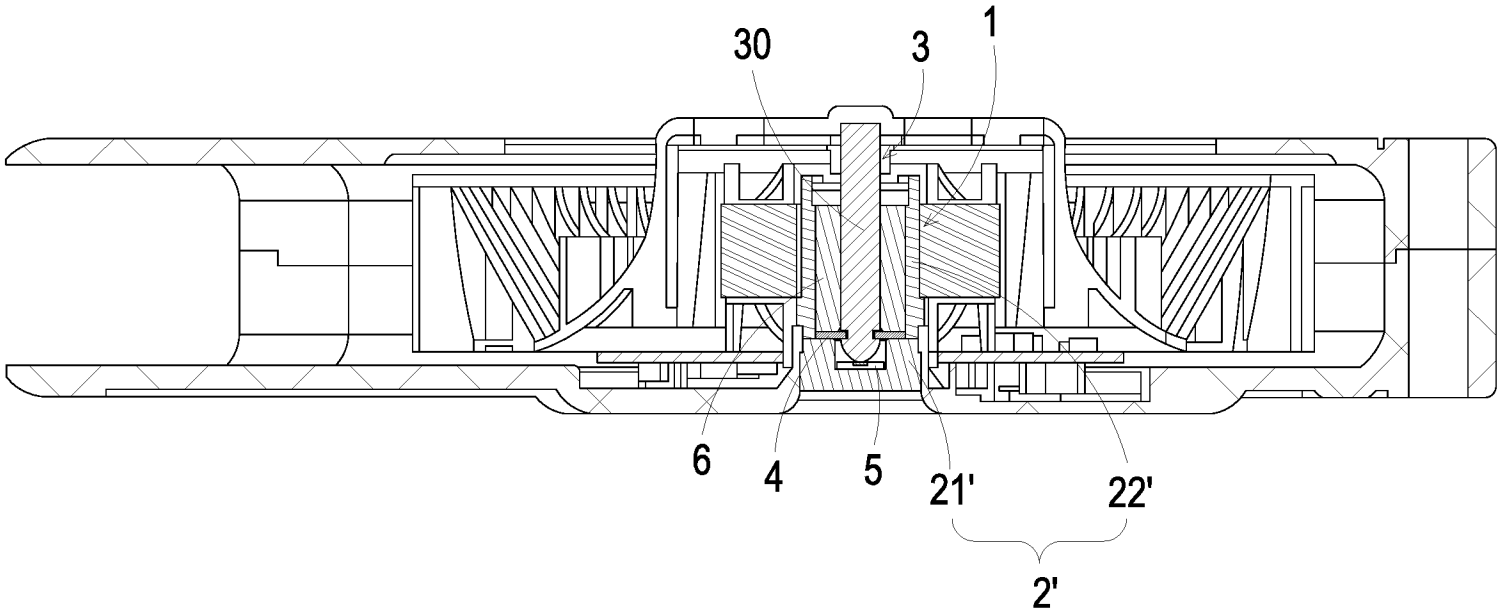
FIG. 4 schematically illustrates the cross-sectional structure of a fan and a motor thereof according to another embodiment of the present disclosure.

Please refer to FIG. 4. FIG. 4 schematically illustrates the cross-sectional structure of a fan and a motor thereof according to another embodiment of the present disclosure. In some embodiments, as shown in FIG. 4, in the motor 1, the base portion 21' and the extending portion 22' of the sleeve 2' are two components, and the extending portion 22' and the bearing 6 are constructed as an open bearing system. During the assembly process of the open bearing system, the base portion 21' is assembled and connected with the extending portion 22', such that the base portion 21' is abutted against the position limiting element 4, and the position limiting element 4 is clamped by the base portion 21' and the extending portion 22', or the position limiting element 4 is clamped by the base portion 21', the extending portion 22' and the bearing 6. Furthermore, the composite elastic element 5 is abutted against the rotating shaft 30, and the bottom surface 40 of the position limiting element 4 is interfaced with the surface 310 of the annular groove 31, but not limited herein.

In brief, in the motor of the present disclosure, by disposing the composite elastic element, which is compressible and is able to rebound, and interfering the position limiting element with the annular groove of the rotating shaft, there is no gap between the bottom surface of the position limiting element and the rotating shaft, such that the generation of vibration noise is prevented, and the abrasion of components is avoided. In addition, through disposing the composite elastic element, which is integrally formed and has the certain hardness, and assembling and matching the position limiting element disposed on the sleeve with the rotating shaft, the noise is avoided from generating, and the assembly of the motor is facilitated.

Please refer to FIG. 1, FIG. 2 and FIG. 3. As shown in FIG. 1, FIG. 2 and FIG. 3, the motor 1 of the present disclosure can be used in a fan 7. The fan 7 includes a base 70, a motor 1 and an impeller 71, and the impeller 71 can be applied to vehicles or electronic devices, but not limited herein. The motor 1 includes a sleeve 2, a rotor 3, a position limiting element 4 and a composite elastic element 5. The sleeve 2 is disposed on the base 70, and the sleeve 2 has a bottom portion 20 and a side wall W, among which the bottom portion 20 and the side wall W constitute an accommodation space C. The rotor 3 has a rotating shaft 30, and the rotating shaft 30 is disposed within the accommodation space C. The rotating shaft 30 has an outer wall 300, an annular groove 31 is formed on the outer wall 300 of the rotating shaft 30, and the annular groove 31 has a surface 310.

The position limiting element 4 is disposed on the sleeve 2, and the position limiting element 4 is extended from the side wall W of the sleeve 2 toward the center of the rotating shaft 30. The position limiting element 4 includes for example but not limited to a retaining ring or a suction buckle. The position limiting element 4 has a bottom surface 40, the bottom surface 40 faces toward the bottom portion 20, and the bottom surface 40 of the position limiting element 4 is interfaced with the surface 310 of the annular groove 31. Furthermore, the composite elastic element 5 is disposed on the bottom portion 20 and abutted against a first end 301 of the rotating shaft 30. The impeller 71 is connected with a second end 302 of the rotating shaft 30, and the second end 302 is, for example but not limited to, penetrated through the impeller 71. In addition, the first end 301 and the second end 302 are located at different ends of the rotating shaft 30.

The components included in the motor 1 and the further detailed structures have been described in the embodiments mentioned above, and are not redundantly described herein. In other words, in the fan and the motor thereof of the present disclosure, through interfering the bottom surface of the position limiting element with the annular groove of the outer wall of the rotating shaft, the gap therebetween is eliminated, so as to avoid the noise of the up and down vibration from generating. Furthermore, by disposing the composite elastic element, which is compressible and is able to rebound, the vibration noise is prevented from generating, the abrasion of components is avoided, and the assembly of the motor and the fan is facilitated.

From the above descriptions, the present disclosure provides a fan and a motor thereof. Through interfering the bottom surface of the position limiting element with the annular groove of the outer wall of the rotating shaft, the gap therebetween is eliminated, so as to avoid the generation of the noise of the up and down vibration and achieve the effect of reducing noise. Furthermore, by disposing the composite elastic element, which is compressible and is able to rebound, and interfering the position limiting element with the annular groove of the rotating shaft, there is no gap between the bottom surface of the position limiting element and the rotating shaft, such that the generation of vibration noise is prevented, and the abrasion of components is avoided. In addition, through disposing the composite elastic element, which is integrally formed and has the certain hardness, and assembling and matching the position limiting element disposed on the sleeve with the rotating shaft, the noise is avoided from generating, and the assembly of the motor is facilitated.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A motor, comprising:

a sleeve having a bottom portion and a side wall, wherein the bottom portion and the side wall constitute an accommodation space;

a rotor having a rotating shaft, wherein the rotating shaft is disposed within the accommodation space, and the rotating shaft has an outer wall, wherein an annular groove is formed on the outer wall;

a composite elastic element disposed on the bottom portion and abutted against a first end of the rotating shaft; and a position limiting element disposed on the sleeve and extended from the side wall toward the rotating shaft until in the annular groove, wherein the rotating shaft is clamped by the position limiting element and the composite elastic element.

2. The motor according to claim 1, wherein the composite elastic element is a composite rubber element, wherein a side surface of the composite rubber element is integrally formed with a wear-resistant structure, and the wear-resistant structure is contacted with the first end.

3. The motor according to claim 1, wherein a Shore A hardness of the composite elastic element is 70 to 90 degrees.

4. The motor according to claim 1 further comprising a bearing, wherein the bearing is accommodated in the sleeve, and the rotating shaft is penetrated through the bearing.

5. The motor according to claim 4, wherein the sleeve comprises:

a base portion having a side edge and the bottom portion; and an extending portion having the side wall, wherein the extending portion is connected with the base portion, wherein the extending portion is contacted with the bearing, and the position limiting element is clamped by the side edge and the bearing, or by the side edge and the extending portion.

6. The motor according to claim 5, wherein the base portion and the extending portion are integrally formed.

7. The motor according to claim 5, wherein the annular groove has a surface, and the position limiting element has a bottom surface, wherein the bottom surface faces toward the bottom portion, and the bottom surface is interfaced with the surface.

* * * * *